United States Patent [19]

Kurachi et al.

[11] 4,412,755

[45] Nov. 1, 1983

[54] TYPEWRITER WITH AN ERASING APPARATUS

[75] Inventors: Hisao Kurachi; Takeo Itoh; Hiroshi Onoda, all of Nagoya, Japan

[73] Assignee: Brother Kogyo Kabushiki Kaisha, Nagoya, Japan

[21] Appl. No.: 332,857

[22] Filed: Dec. 21, 1981

[30] Foreign Application Priority Data

Dec. 29, 1980 [JP] Japan ..... 55-187434

[51] Int. Cl.[3] ..... B41J 29/16

[52] U.S. Cl. ..... 400/697.1; 400/54

[58] Field of Search ..... 400/54, 697, 697.1

[56] References Cited

U.S. PATENT DOCUMENTS

| | | | |
|---|---|---|---|
| 3,349,886 | 10/1967 | Madison et al. | 400/54 X |
| 3,718,243 | 2/1973 | Chvatlinsky | 400/54 X |
| 3,882,990 | 5/1975 | Genesio | 400/697.1 |
| 4,108,557 | 8/1978 | Skrzipek et al. | 400/697.1 |
| 4,309,118 | 1/1982 | Terashima | 400/697.1 |

FOREIGN PATENT DOCUMENTS 1316534 5/1973 United Kingdom .

*Primary Examiner*—Clifford D. Crowder

*Attorney, Agent, or Firm*—Browdy & Neimark

[57] ABSTRACT

A typewriter driven by an electric motor and provided with a ribbon vibrator for moving an erase ribbon in place of an ordinary printing ribbon as an occasional substitution from original position to printing position according to operation of a printing device for common use to both to erase a mistyped character. The ribbon vibrator is normally retained in non-operative status by a retaining member, which is moved in response to depression of a correction key to a predetermined evacuation position to allow the ribbon vibrator to operate and locked there by a lock member. The lock member is associated with not only a release key but also a manual switch member for controlling power supply to the electric motor. The engagement between the lock member and the retaining member is released in response to a turning operation of the manual switch member to OFF position for automatically restoring the ribbon vibrator to the non-operative status.

20 Claims, 5 Drawing Figures

TYPEWRITER WITH AN ERASING APPARATUS

BACKGROUND OF THE INVENTION

This invention relates to a typewriter with an erasing apparatus capable of erasing characters once printed on a sheet of printing paper, and particularly to a typewriter having a manual release means for the erasing apparatus.

A British Pat. No. 1,316,534 discloses a method of and apparatus for removing printed characters from a printing paper on which they have been printed by means of striking an erase or correction ribbon having an adhesive surface on those printed characters. In this apparatus the characters have to be erased or removed by a same printing mechanism which has been used in the printing thereof.

In a typewriter provided with this erasing apparatus an undermentioned operation is carried out when, for example, a character "H" is required after having been once printed to be erased.

A carriage of the typewriter is first of all spaced backwards by one character-size increment so as to set the next print position over the place where the character "H" has been printed, and at the same time or immediately thereafter the erase ribbon is so preset as to be ready for being lifted from an original position to a print position according to one character printing operation in a printing mechanism, just like in a character printing ribbon used in ordinary printing operations. A type "H" is then struck by the printing mechanism on the printed "H" via the erase ribbon.

In typewriters of this kind the preset state is generally, when erasing operation is performed, automatically released due to its structure even when the erasing apparatus is placed under a preset state ready to work. However, in a case wherein the power switch for the electric main motor is turned OFF, with the erasing apparatus being left at a preset state without performing erasing operation, or the erasing apparatus is placed at a preset state after turning OFF of the power switch, re-starting of printing operation accompanied by returning ON of the power switch will not cause a normal printing operation. Under such a situation a typist is liable disadvantageously to have a delusion of a machine trouble, because the typewriter performs an erasing operation instead of the normal printing operation due to its being kept at the preset state when he/she re-starts the typing.

SUMMARY OF THE INVENTION

It is a primary object of this invention, which was made from such a background, to provide a typewriter wherein the erasing apparatus kept in a preset state can be automatically released by operation of a power switch apparatus, so that the typist may be relieved of such a delusion as above-mentioned.

It is another object of this invention to provide a typewriter wherein manual operating means for presetting the erasing means can be automatically made idle when the power switch apparatus is turned OFF.

It is another object of this invention to provide a typewriter wherein the erasing apparatus can be released of its preset state due to not only operation of the power switch apparatus but also operation of a separately disposed manual member.

It is still another object of this invention to achieve the above-mentioned objects as inexpensively as possible.

This invention is applied to a typewriter having means for printing selected characters, erasing means for supporting an erase ribbon to move the same from original position to printing position in response to printing operation of the printing means, and a manual switch member manually operated for controlling power supply to a main motor of the typewriter. A retaining member is disposed movably between first and second positions. The retaining member is normally positioned at the first position to retain the erasing means in non-operative status and is moved by manual operating means to the second position to allow the erasing means to operate in response to the printing operation of the printing means. The retaining member is locked at the second position by locking means, which locking means is released in response to the printing operation of the printing means. And there is further disposed means for returning the retaining member held at the second position by locking means to the first position in response to operation of the manual switch member.

The retaining member can be made capable of returning to the first position in response to operation of turning OFF the manual switch member; it can be on the contrary made capable of returning to the first position even in response to turning operation of the manual switch member to ON. In the former instance, i.e., when the retaining member is so designed as to be returnable to the first position in response to the turning operation of the manual switch member to OFF, it is preferable to keep the retaining member from being locked at the second position by the locking means, even when the manual operating means is operated while the manual switch member is in OFF state. It is further possible for the retaining member to be designed such that it is returned to the first position also due to operation of another predetermined key, for example, a margin release key.

DETAILED DESCRIPTION OF THE PREFERRED EMBODIMENT

With reference to the appended drawings a preferred embodiment of this invention will be described.

Figure 1:
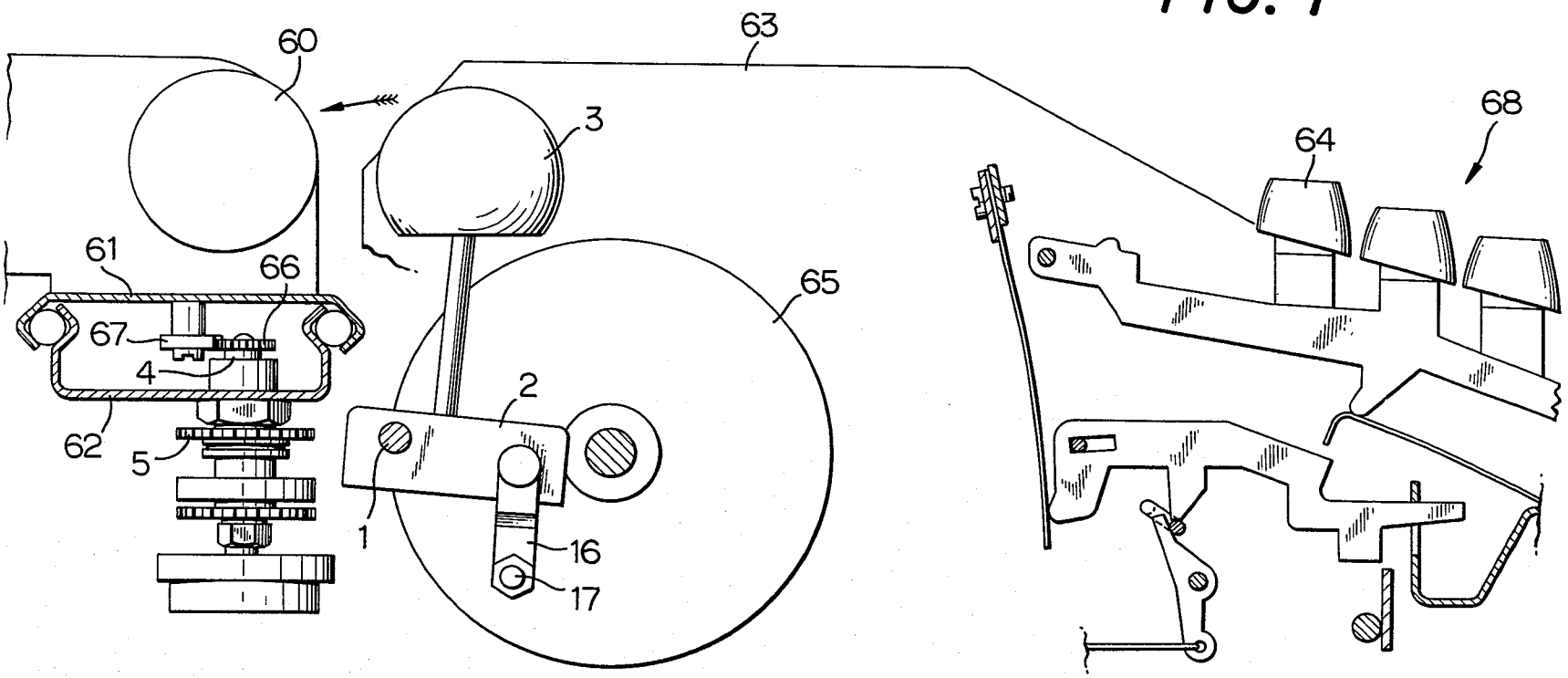
FIG. 1 is a sectional side elevation of an embodiment of a typewriter in accordance with this invention.

In FIG. 1, a platen 60 is disposed on the upper portion of a carriage 61 which is movably carried in a lateral direction on a base plate 62 placed on the rear portion of a typewriter frame 63. On the front side of the platen 60 a rocker platform 2 is pivoted by a rocker shaft 1. On the rocker platform 2 a print head 3 of substantially spherical form with a multiplicity of types arranged on the external surface thereof is retained inclinably as well as rotatably. Due to selecting operation out of a multiplicity of type keys 64 arranged on a keyboard 68 of the typewriter a given type on the print head 3 is so selected as to be faced to a printing point of the platen 60. The rocker shaft 1 is driven by a main motor 65 via a not-shown ordinary transmission mechanism. Printing operation is executed by striking of the selected type key 64, caused by a rotative movement of the rocker platform 2 together with the rocker shaft 1, on the printing paper via an ordinary ink ribbon. An escapement device for intermittently moving the carriage 61 in the printing direction in response to the printing operation will be explained next. On a shaft 4 rotatably supported on the earlier mentioned base plate 62 a pinion 66 engageable with a rack 67 and a latchet wheel 5 for shifting the carriage 61 at a predetermined pitch are respectively fixed. The shaft 4 is rotatively biased via the rack 67 and pinion 66 in a direction indicated with an arrow in FIG. 2 due to biasing force given to the carriage 61 through a suitable means (not shown) in the printing direction.

Figure 2:
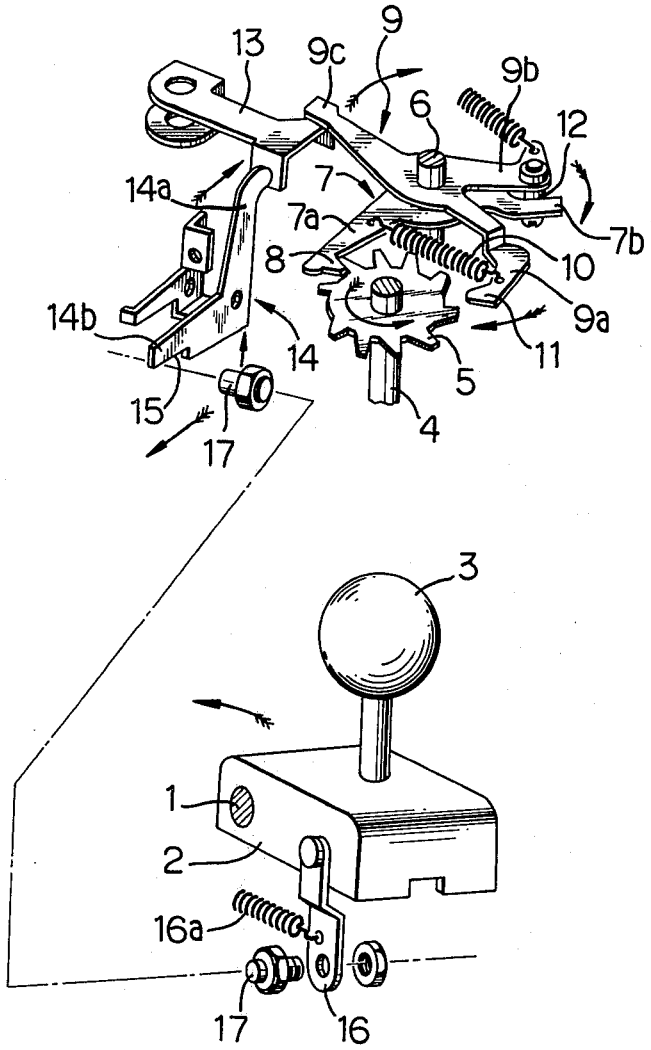
FIG. 2 is a perspective view for showing a rocker platform with a print head and an escapement device in the typewriter.

As shown in FIG. 2, on a shaft 6 extending parallelly to the shaft 4 on the rear side of the latchet wheel 5 a first pawl 7 with a pair of arms 7*a*, 7*b* is rotatably retained: one arm 7*a* of the same is provided with an engagement section 8 engageable with the latchet wheel 5, the other arm 7*b* being extended in an opposite direction to the former.

On the shaft 6 a second pawl 9 of trifurcated arm shape is so carried as to be coaxially rotatable with the first pawl 7. Between a first arm portion 9*a* of the second pawl 9 and the one arm 7*a* of the first pawl 7 a tension spring 10 is anchored. The first arm portion 9*a* provided with an engagement section 11 is engaged with the latchet wheel 5 on the opposite side, with the latchet wheel 5 being sandwiched between the one arm portion 7*a* and the first arm portion 9*a*, to the one arm portion 7*a*.

On a second arm portion 9*b* of the second pawl 9 an eccentric screw 12 is secured for being engageable with the other arm portion 7*b* of the first pawl 7. Both pawls 7, 9 are therefore under the influence of the tension spring 10 normally in engagement so as to be rotatable in unison. A third arm portion 9*c* of the second pawl 9 is engaged with one side of a first crank 13, which is rotatably supported on an axis extending on the left side of, in parallel with, the shaft 6, for being rotatable clockwise in FIG. 2 accompanied by the rotation of the first crank 13.

On the front side of the first crank 13 a second crank 14 is rotatably supported on an axis extending in a normal direction to the shaft 6. One arm portion 14*a* of the second crank 14 is engaged with the other side of the first crank 13 so as to make the first crank 13 rotate following after the rotation of the second crank 14. The other arm portion 14*b* of the second crank 14 is provided with an engagement portion 15 for being normally engaged, due to the action of a tension spring 16*a*, with a pin 17 fixed on one end of connecting plate 16 which is pivoted at the other end thereof on one side of the rocker platform 2.

When, therefore, the rocker platform 2 has been anticlockwise rotated for printing, both pawls 7, 9 are integrally rotated in a clockwise direction by the action of the first and second cranks 13, 14 which are actuated by movement of the pin 17. Then the engagement between the engagement sections 8, 11 and the latchet wheel 5 is respectively changed by one tooth so as to shift the carriage 61 by one half pitch or space in the printing direction. When thereafter the rocker platform 2 is restored to the original position, it brings both pawls 7, 9 back to the original position shown in FIG. 2 so as to further shift the carriage 61 by one half pitch. By repeating the above operation the carriage 61 is shifted in the printing direction intermittently at each printing operation of the print head 3.

Structure of an erasing apparatus for erasing mistyped character or characters will be described next referring to FIG. 3. On the front side of the platen 60 a ribbon vibrator 18 consisting of a pair of arms 18*a*, 18*b*, which extend in a manner of sandwiching the print head 3 therebetween, and a connecting rod 18*c* for connecting both arms 18*a*, 18*b* is pivoted on the typewriter frame 63. The ribbon vibrator 18 supports at the upper end of both arms 18*a*, 18*b* a correction or erase ribbon CR and is rotatably biased clockwise by a tension spring 19 mounted on the lower end of one arm 18*a*.

On the outer side of, at the upper portion of, the one arm 18*a* a pair of pins 22, 23 are erectly disposed, and on the outer side, at the lower portion of, the one arm 18*a* a cam follower 21 engageable with a cam 20, which is rotated one round by the electric main motor per one character printing executed in response to depressing of every type key 64, is erectly disposed. The cam 20 is of eccentric shape for being functionable such that while it is stationary the maximum diameter portion thereof is engaged with the cam follower 21 so as to retain the erase ribbon CR at the lower original position, and changing of the connecting surface of the cam 20 from the maximum diameter portion to the minimum diameter portion thereof due to the above-mentioned rotation of the cam 20 causes the erase ribbon CR to be shifted from the lower original position to the upper printing position.

Beneath the ribbon vibrator 18 a retaining member such as a crank 24 of substantially inverted U-shape is pivoted on the typewriter frame 63 rotatably about an axial line parallel to the rotation axis of the ribbon vibrator 18. On the lower end thereof a notch 24*a* of arcuate shape is formed and a tension spring 25 is anchored so as to rotatively bias the crank 24 in anticlockwise direction. An arm portion 26 extending from the crank 24 is detachably engaged at the tip thereof with the one arm 18*a* of the ribbon vibrator 18. On another arm portion 27 of the crank 24 extending in the opposite direction to the arm portion 26 an engagement portion 28 is formed at the tip thereof. Inside the inverse U-shaped crank 24 a release lever 30 is disposed rotatably about the same axis as the crank 24. An engagement portion 30*a* formed in the neighborhood of the tip thereof is engageable with the engagement portion 28 of the crank 24. Between the ribbon vibrator 18 and the crank 24 a lock member such as a lock link 32 is rotatably disposed for being rotatively biased in clockwise direction by a tension spring 33 anchored between itself and the release lever 30, and a cam portion 32*a* on the upper end thereof is made engageable with the one engaging pin 22 on the ribbon vibrator 18. The lock link 32 is provided with on the lower end thereof an engaging portion 32*b* and in the middle thereof an engaging portion 32*c* erectly formed. And the engagement portion 30*a* of the release lever 30 is normally engaged with the lower end of the lock link 32, with the engagement portion 28 of the crank 24 being in engagement with the lower portion of the lock link 32 at one side thereof as shown in FIGS. 3 and 4. When the crank 24 is clockwise rotated from this status, it is engaged at the engagement portion 28 thereof with the engaging portion 32*b* of the lock link 32 so as to prevent itself, i.e., the crank 24, from returning rotation to the original position.

On the rear side of the lock link 32 a crank 34 is rotatably mounted on the typewriter frame 63 under rotative biasing force in anticlockwise direction by a tension spring 35. One arm portion 34*a* of the crank 34 is engaged with the other engaging pin 23 of the ribbon vibrator 18 for being able to rotate following after the rotation of the ribbon vibrator 18.

To the lower end of the other arm portion 34*b* of the crank 34 a disconnecting member such as a hook-shaped link 36 is rotatably connected and a pin 36*a* disposed substantially in the middle portion thereof is normally held in engagement with an engaging portion 34*c* disposed on the lower portion of the other arm portion 34*b*.

On the front side of the link 36 there is a pin 17 connected to one side of the rocker platform 2 via the connecting plate 16, being normally in engagement with one side of the link 36.

Figure 5:
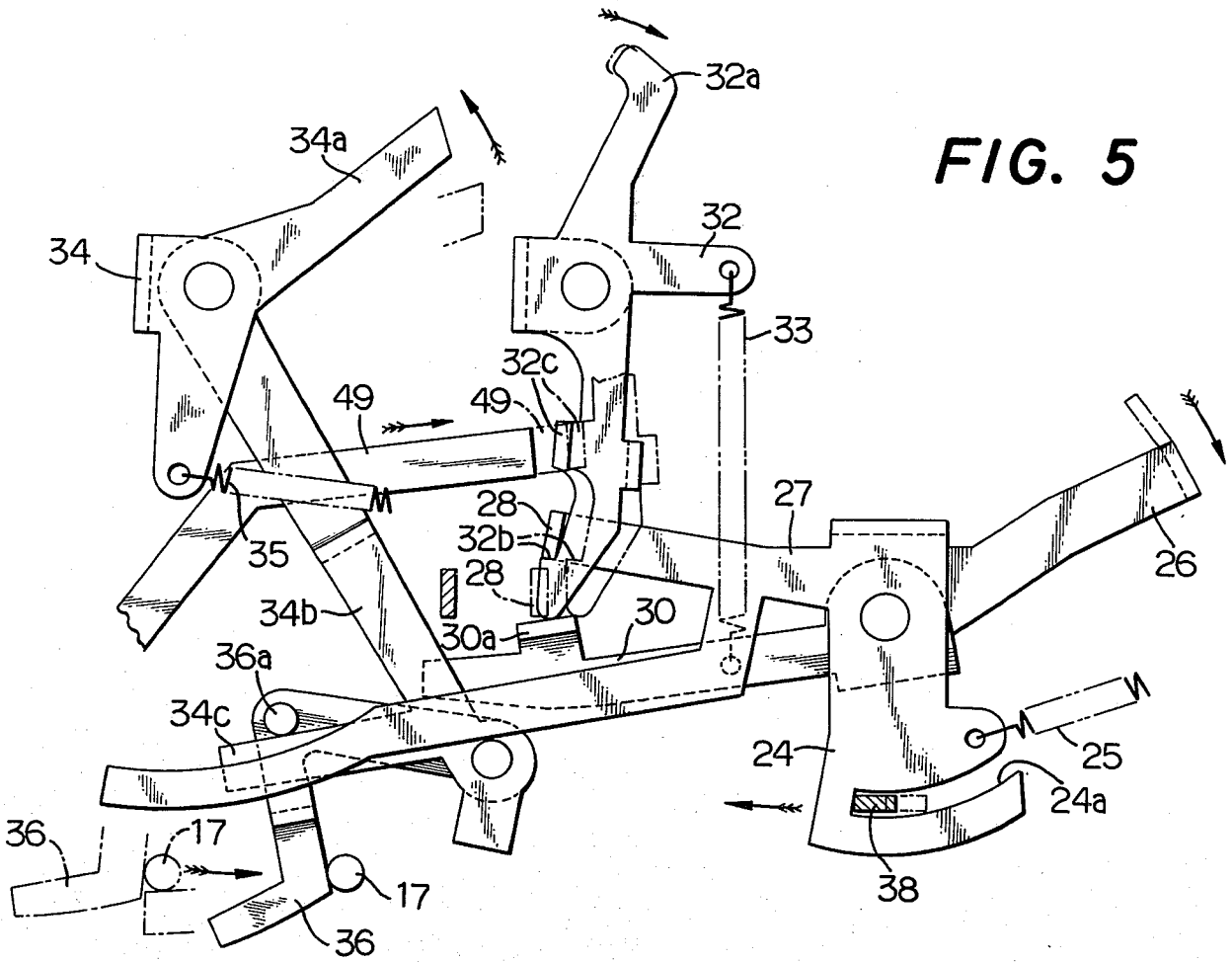
FIG. 5 is a side view of an essential part of the erasing apparatus for showing a different operational status.

An erase presetting apparatus for placing the ribbon vibrator 18 at an operation ready status must be described next. As shown in FIG. 3 a correction or erase key 37 is rotatably retained, in the front portion of the typewriter frame, on one end of a key lever therefor, being anticlockwise rotatably biased by a tension spring 37*a*. On the other end of a key lever a bent portion 37*b* is formed such that a rod or connecting plate 38 is put between the bent portion 37*b* and a notch 24*a* formed in the crank 24. The connecting plate 38 is forwardly biased by a tension spring 39. When therefore the correction key 37 is depressed for erasing a mistyped character, the bent portion 37*b* is engaged with an engaging portion 38*a* of the connecting plate 38 so as to shift the connecting plate 38 rearwards resisting the spring force of the tension spring 39, followed by clockwise rotation of the crank 24 as shown in FIG. 5. Both the correction key 37 and the connecting plate 38 are restored not later than release of the depression of the correction key 37 to their respective original position owing to the action of the tension springs 37*a* and 39.

An operation ready status releasing mechanism for compulsorily releasing an operation ready status of the ribbon vibrator 18 will be described next with reference to FIG. 4. Beneath the carriage in the rear portion of the typewriter frame a carriage stopper 40 is retained with a pair of supporting portions 41 disposed on either side thereof (only one of them is illustrated) laterally shiftably, i.e., in normal direction to the sheet of the drawing, and rotatably in a parallel plane to the sheet, while being biased to clockwise rotate by the action of a tension spring 42. The upper end of the carriage stopper 40 is formed into a bent portion 43. According to lateral movement of the carriage 61, while keeping the angular position of the bent portion 43 shown in FIG. 4, a well known margin stopper (not shown) attached to the carriage 61 is engaged with the bent portion 43 so as to restrain the movement of the carriage 61. Anticlockwise rotation of the carriage stopper 40 in this status due to depressing of a later described margin release key 44 will cause releasing of the carriage from the restrained status.

In the front portion of the typewriter frame the margin release key 44 is rotatably retained by one end of a key lever 45 therefor, being anticlockwise biased by a tension spring 46. On the lower end of an arm of a key lever 45 an engaging portion 45*a* is erectly formed, and in the middle of the arm a bent portion 45*b* is formed.

Beneath the margin release key 44 a crank 47 for releasing a margin stopper is disposed, being rotatably supported almost at the middle part thereof. Between the lower end of the crank 47 and a slot 40*a* formed on the lower end of the carriage stopper 40 a connecting rod 48 is spanned to link the both. And due to the spring force of the tension spring 42 for the carriage stopper 40, a bent portion 47*a* of the crank 47 is engaged with the engaging portion 45*a* of the key lever 45.

Between the lower end of the carriage stopper 40 and the lock link 32 a correction release member such as a release rod 49 is disposed, which is connected through a slot 49*a* on the rear end thereof to the connecting rod 48 and engageably faced at the front end thereof to the engaging portion 32*c* of the lock link 32.

In the front portion of the typewriter frame a power supply switch 50 is secured. Above the switch 50 a manual switch member such as a switch lever 51 rotatably retained by the typewriter frame is disposed side by side the key lever 45. On an upwardly extended first arm 51*a* of the switch lever 51 a manual operating portion 52 is formed, on a rearwardly extended second arm 51*b* a projection 54 located above an actuator 53 of the switch 50 is formed, and on a forwardly extended third arm 51*c* a torque spring 55 is anchored. This torque spring 55 is for holding the switch lever 51 either at ON position wherein the projection 54 of the switch lever 51 presses the actuator 53 of the switch 50 to close the same and at the same time the third arm 51*c* is engaged with a stopper 56 formed on the typewriter frame, or at OFF position wherein the projection 54 is departed from the actuator 53 to open the switch 50.

On the tip of the second arm 51*b* of the switch lever 51 a stud 57 with a horizontal posture is so secured as to face a bent portion 45*b* of the key lever 45. This stud 57 is held, while the switch lever 51 is being at the ON position, off from the bent portion 45*b* of the key lever 45, and abuts on the bent portion 45*b*, when the switch lever 51 is clockwise rotated from the ON position to the OFF position, so as to rotate the key lever 45 in clockwise direction. The engaging portion 45*a* of the key lever 45 is thereby pressed on the bent portion 47*a* on the upper end of the crank 47 for anticlockwise rotating and keeping the crank 47 at the rotated position. And the crank 47, the connecting rod 48, and the release rod 49 constitute the operation ready status releasing mechanism.

Function of the erasing apparatus will be described hereunder.

In case of mistype of a single character the printing paper on the platen 60 is moved by one space or increment in the reverse direction by depressing of a not-shown back space key. Depressing of the correction key 37 at this stage will clockwise rotate the crank 24 from an original or first position shown in FIG. 4 to a second position as shown in FIG. 5 caused by the shifting of the connecting plate 38 and will make the engagement portion 28 of the arm portion 27 engage with the engaging portion 32*b* of the lock link 32 so as to bring the crank 24 to a locked status. At this time the release lever 30 and the lock link 32 are held in engagement.

Figure 3:
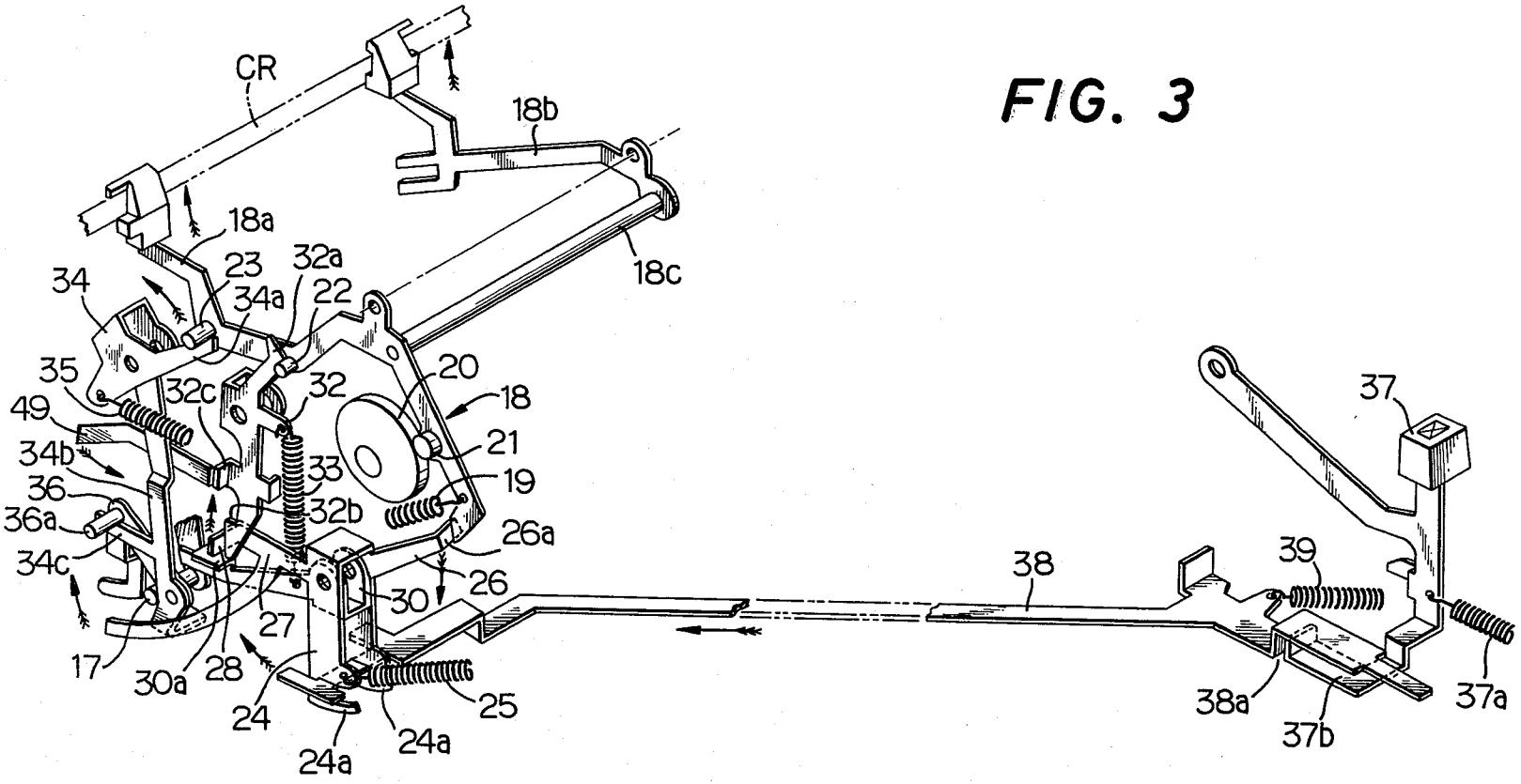
FIG. 3 is a perspective view of an erasing apparatus in the typewriter.
Figure 4:
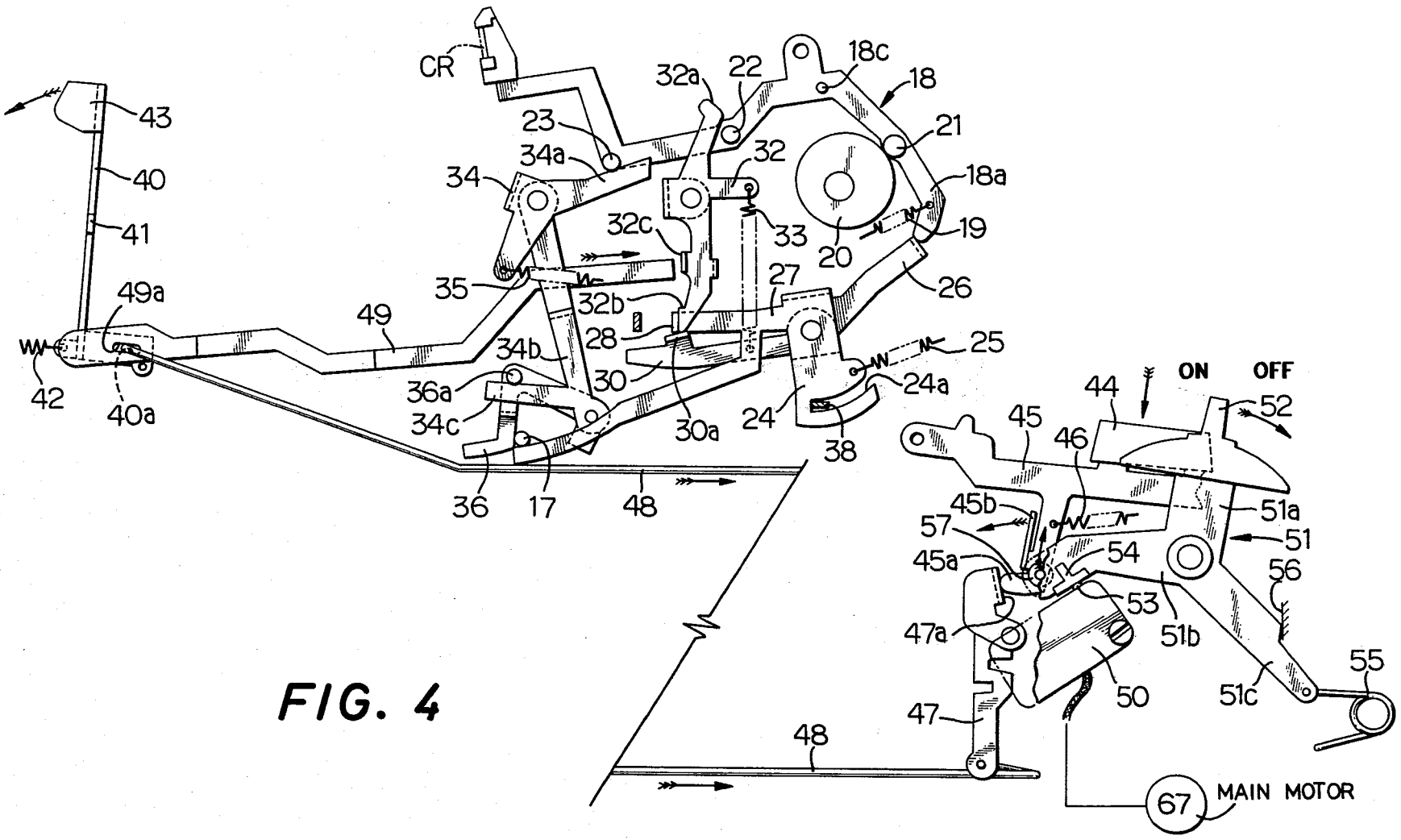
FIG. 4 is a side view of the erasing apparatus.

Due to disengagement, on the other hand, of the arm portion 26 from the lower end of the one arm 18*a* of the ribbon vibrator 18 caused by the rotation of the crank 24, the ribbon vibrator 18 is preset or placed at a ready status to be clockwise rotated, from the original position shown in FIGS. 3 and 4 to the printing position by the action of the tension spring 19, while the cam 20 is rotated to change its contact portion with the cam follower 21 from the maximum diameter portion to the minimum diameter portion.

When thereafter the type key 64 is depressed again for erasing the mistyped character by the printing operation, the ribbon vibrator 18 is lifted up to the printing position by the movement of the cam follower 21 caused by the rotation of the cam 20. The mistyped character is erased by the erase ribbon CR supported on the tip of the ribbon vibrator 18. The crank 34 is then anticlockwise rotated following after the lifting movement of the ribbon vibrator 18 through engagement of the pin 23 with the arm portion 34*a*, accompanied by rotation of the link 36 together with the crank 34 through engagement of the pin 36*a* of the link 36 and the engaging portion 34*c* of the crank 34, so as to forwardly move the pin 17 which is in abutment on one side surface of the link 36 against the biasing force of the tension spring 16*a*. This will allow the pin 17 to be forwardly disengaged from the engaging portion 15 of the second crank 14 in the escapement device in FIG. 2 for making the escapement device ineffective. Therefore printing operation due to depressing of the type key 64 will never cause a one-space movement of the printing paper on the platen 60 in the printing direction.

When the ribbon vibrator 18 is raised upwardly toward the printing position the lower end of the one arm 18*a* of the ribbon vibrator 18 comes first to above the bent portion 26*a* on the tip of the arm portion 26 of the crank 24. Further rising of the ribbon vibrator 18 causes the pin 22 fixed thereto to engage with the lock link 32 at the cam portion 32*a* thereof so as to rotate the same in anticlockwise direction in FIG. 5. It will release the engagement between the engaging portion 32*b* of the lock link 32 and the engagement portion 28 of the crank 24. Due to thereby caused rotation of the crank 24 by the action of the tension spring 25, the bent portion 26*a* of the arm portion 26 is restored so far as it abuts the external edge of the one arm 18*a* of the ribbon vibrator 18.

After completion of erasing operation of a mistyped character, restoration of the ribbon vibrator 18 from the printing position to the original position gives rise to sliding contact between the external edge of the one arm 18*a* of the ribbon vibrator 18 and the upper edge of the bent portion 26*a* of the arm portion 26 of the crank 24 before the ribbon vibrator 18 is finally kept at the stationary or non-operative status shown in FIG. 4. And the crank 34 is clockwise rotated due to the returning movement of the ribbon vibrator 18, accompanied by returning to the original position in FIG. 4 of the link 36 together with the pin 17, so as to return the pin 17 to an engaged status with the engagement portion 15 of the second crank 14 for making the escapement device effective or operative. This consequently permits printing operation with an ordinary ink ribbon accompanied by the subsequent intermittent movement due to depression of the type keys 54.

Besides, a long arm branched from the arm 27 of the crank 24, the release lever 30, and the link 36, etc., are all disposed for a different operation from the above description when a consecutive erasing operation is required. Description of their operation mode is omitted herewith because of its little relation to the present invention.

The operation ready status releasing mechanism, which is operated in close linkage with both the depressing operation of the margin release key 44 and the turning OFF operation of the switch lever 51, will be described in respect of its function.

When the correction key 37 is erroneously depressed while the switch 50 is in ON status as shown in FIG. 4 to put the ribbon vibrator 18 at the operation ready status, depressing of the margin release key 44 will cause the crank 47 shown in FIG. 4 to be anticlockwise rotated, and the carriage stopper 40 to be in turn anticlockwise rotated via the connecting rod 48 so as to move the release rod 49 rightwardly in FIG. 4. The release rod 49 is, through the movement thereof, engaged at the tip thereof with the engagement portion 32*c* of the lock link 32 which is locking the crank 24 as shown in FIG. 5 so as to anticlockwise rotate the lock link 32 as far as the position shown in FIG. 5 with a two-dot-chain line. It in turn causes the engagement portion 28 of the crank 24 to be disengaged from the engaging portion 32*b* for restoring the crank 24 by rotating to the status shown in FIGS. 3 and 4. The arm portion 26 of the crank 24, is thereby engaged with the one arm 18 *a* of the ribbon vibrator 18, so that the ribbon vibrator 18 may be compulsorily released from the operation ready status. The margin release key 44, the crank 47, the connecting rod 48, and the release rod 49 are all restored to the original position, simultaneously with the release of depression of the margin release key 44, due to the action of the tension springs 46, 42. The typewriter is therefore placed in a ready status for continuing ordinary printing operation, after having been released of the erasing operation ready status.

When the switch 50 is turned OFF due to clockwise rotation of the switch lever 51 at a status, wherein the ribbon vibrator 18 is being kept ready to operate owing to depression of the correction key 37, the key lever 45 is clockwise rotated by means of being urged at the bent portion 45*b* thereof in an arrow marked direction in FIG. 4 and retained thereafter at the rotated position by the keeping action of the torque spring 55. The release rod 49 will be thereby forwardly shifted by way of the crank 47 and the connecting rod 48, so that the tip of the release rod 49 is kept in engagement with the engagement portion 32*c* of the lock link 32 as illustrated in FIG. 5 with a two-dot-chain line. The rotation of the crank 24 will therefore cause the arm portion 26 to be engaged with one arm 18*a* of the ribbon vibrator 18, so that the ribbon vibrator is kept at the released status from the operation ready posture. It means that the operation ready status of the ribbon vibrator 18 can surely be released whenever the switch 50 is turned OFF by the switch lever 51, and that the ribbon vibrator 18 can never be put in the operation ready status even when the correction key 37 is depressed by mistake, while the switch 50 is in OFF position, because the lock line 32 is not positioned on the rotational locus of the engagement portion 28 of the crank 24. The crank 24 is then rotated by a certain angle only idly without engagement with the lock link 32. In other words, the torque spring 55 functions as preventive means for preventing, even when the correction key 37 is depressed, the erasing apparatus from being preset to operable status.

When the switch 50 is turned ON again by the switch lever 51, urging action on the key lever 45 by the stud 57 of the switch lever 51 is released so as to restore the key lever 45 from the rotated position back to the original position in FIG. 4 by the action of the tension spring 46, followed by rotational returning of the lock line 32, due to the earlier mentioned link mechanism and the action of the tension spring 33, from the position shown with a two-dot-chain line to the position of a one-dot-chain line in FIG. 5. It allows thereby the erasing apparatus to be placed again at a posture capable of being preset in the operation ready status.

This invention is of course not to be limited to the above described embodiment, but many alterations or modifications are allowed for those skilled in the art within the spirit and scope of the invention.

What is claimed is:

1. A typewriter driven by an electric motor and provided with an erasing apparatus comprising:

means for printing selected characters;

erasing means for supporting an erase ribbon to move the same from an original position to a printing position in response to printing operation of said printing means;

a retaining member disposed movably between a first position and a second position, and normally positioned at the first position to retain said erasing means in a non-operative status;

manual operating means for moving said retaining member to the second position to preset said erasing means in an operative status wherein the erasing means is operable in response to the printing operation of said printing means;

means for locking said retaining member at the second position, said retaining member held at the second position by said locking means being returned to the first position in response to the printing operation of said printing means;

a manual switch member movable between an ON position and an OFF position for controlling the power supply to said electric motor; and means for returning said retaining member held at the second position by said locking means to the first position in response to movement of said manual switch member from said ON position to said OFF position.

2. A typewriter in accordance with claim 1, wherein (i) said erasing means comprises a ribbon vibrator which is rotatably disposed about a horizontal axis for supporting at the end portion thereof said erase ribbon, a cam whose peripheral surface constitutes a cam surface and is capable of rotating one turn during a single printing operation of the printing means, a cam follower disposed on said ribbon vibrator, and a spring for biasing said ribbon vibrator such that said cam follower is so positioned as to contact the cam surface when said retaining member is set at the second position, and (ii) said retaining member is capable of blocking the rotation of said ribbon vibrator, irrespective of the rotation of said cam, by means of engaging the ribbon vibrator when said retaining member is set at said first position.

3. A typewriter in accordance with claim 2, wherein said locking means includes a lock member provided with an engaging portion which is to be engaged, when said retaining member is moved to the second position, with said retaining member so as to keep it at the second position, and the engagement of said lock member with said retaining member is released by movement of a release member disposed on said ribbon vibrator caused by operation of said ribbon vibrator.

4. A typewriter in accordance with claim 1, wherein said manual operating means includes a correction key disposed on a keyboard and manually operable, and a member for moving said retaining member to the second position in response to depressing operation of said correction key.

5. A typewriter in accordance with claim 1, wherein said locking means includes a lock member provided with an engaging portion which is to be engaged, when said retaining member is moved to the second position, with said retaining member so as to keep it at the second position.

6. A typewriter in accordance with claim 4, wherein said returning means includes a release member capable of engaging with said lock member for moving said lock member in such a direction wherein the engaging portion thereof is disengaged from said retaining member, and a link mechanism for associating said release member with said manual switch member.

7. A typewriter in accordance with claim 5, wherein (i) said returning means includes a release member capable of engaging with said lock member for moving said lock member in such a direction wherein the engaging portion thereof is disengaged from said retaining member, and a link mechanism for associating said release member with said manual switch member, and (ii) said release member is kept at such a position as to prevent said lock member from being engaged with said retaining member due to holding of the manual switch member at OFF position.

8. A typewriter in accordance with claim 1 further comprising a preventive means for preventing, even when said manual operating means is operated, said erasing means from being preset to operable status.

9. A typewriter in accordance with claim 1 further comprising a manual key disposed on a keyboard and associated with said returning means to manually return said retaining member from the second position to the first position.

10. A typewriter driven by an electric motor comprising:

means for printing characters by selected types;

a cam rotating one round per each one printing operation of said printing means;

a ribbon vibrator rotatably disposed, with a cam follower which cooperates with said cam, for moving an erase ribbon, per each one printing operation of said printing means, from an original position to a printing position;

a crank rotatably disposed between a first position and a second position, and capable of preventing, by being engaged with said ribbon vibrator at the first position, said ribbon vibrator from following the rotation of said cam;

an erase presetting apparatus manually operable for moving said crank to the second position, where the crank is not engaged with the ribbon vibrator, and for presetting said ribbon vibrator at an operation redy status where said erase ribbon can be moved following the rotation of said cam to the printing position;

a lock link which is to be engaged with said crank which has been moved to the second position, said lock link being so positioned, while it keeps said crank at the second position, as to be engageable with a first release member disposed on said ribbon vibrator, and capable of being disengaged from said crank by the first release member when the ribbon vibrator has been rotated by a predetermined amount from the original position to the printing position;

a release key disposed on a keyboard;

an operation ready status releasing mechanism disposed for cooperating with said release key to release the engagement between said lock link and said crank, when said release key is depressed, so that the operation ready status of the ribbon vibrator is thereby released;

a power switch apparatus including a manual switch member for controlling power supply to said electric motor;

a spring means for selectively holding said manual switch member either at an ON position and at an OFF position; and means for actuating said operation ready status releasing mechanism, when said manual switch member is turned to OFF position, and letting said operation ready status releasing mechanism keep the lock link in a position prevented from engaging said crank, while said manual switch member is kept at the OFF position, whereby said erase presetting apparatus can not perform erase presetting while said manual switch member is kept at the OFF position.

11. A typewriter driven by an electric motor and provided with an erasing apparatus comprising:

means for printing selected characters;

erasing means for supporting an erase ribbon to move the same from original position to printing position in response to printing operation of said printing means, said erasing means comprising a ribbon vibrator which is rotatably disposed about a horizontal axis for supporting at the end portion thereof said erase ribbon, a cam whose peripheral surface constitutes a cam surface and capable of rotating one turn according to a single printing operation of the printing means, a cam follower disposed on said ribbon vibrator, and a spring for biasing said ribbon vibrator such that said cam follower is so positioned as to contact with the cam surface;

a retaining member disposed movably between first and second positions to retain said erasing means in non-operative status, said retaining member being capable of blocking the rotation of said ribbon vibrator, irrespective of the rotation of said cam, by means of engaging with the ribbon vibrator when said retaining member is set at said first position;

manual operating means for moving said retaining member to the second position to preset said erasing means in an operative status wherein the erasing means is operable in response to the printing operation of said printing means;

means for locking said retaining member at the second position, said retaining member held at the second position by said locking means being returned to the first position in response to the printing operation of said printing means;

a manual switch member for controlling power supply to said electric motor; and means for returning said retaining member held at the second position by said locking means to the first position in response to operation of said manual switch member.

12. A typewriter in accordance with claim 11, wherein said locking means includes a lock member provided with an engaging portion which engages, when said retaining member is moved to the second position, with said retaining member so as to keep it at the second position, and the engagement of said lock member with said retaining member is released by movement of a release member disposed on said ribbon vibrator caused by operation of said ribbon vibrator.

13. A typewriter driven by an electric motor and provided with an erasing apparatus comprising:

means for printing selected characters;

erasing means for supporting an erase ribbon to move the same from original position to printing position in response to printing operation of said printing means;

a retaining member disposed movably between first and second positions and normally positioned at the first position to retain said erasing means in non-operative status;

manual operating means for moving said retaining member to the second position to preset said erasing means in an operative status wherein the erasing means is operable in response to the printing operation of said printing means;

means for locking said retaining member at the second position, said retaining member held at the second position by said locking means being returned to the first position in response to the printing operation of said printing means, said locking means including a lock member provided with an engaging portion which engages, when said retaining member is moved to the second position, with said retaining member so as to keep it at the second position;

a manual switch member for controlling power supply to said electric motor; and means for returning said retaining member held at the second position by said locking means to the first position in response to operation of said manual switch member, said returning means including a release member capable of engaging with said lock member for moving said lock member in such a direction as to disengage the engaging portion from said retaining member, said returning means further including a link mechanism for associating said release member with said manual switch member.

14. A typewriter in accordance with claim 13, wherein said release member is kept at such position as to prevent said lock member for engaging said retaining member due to holding of the manual switch member at OFF position.

15. A typewriter driven by an electric motor and provided with an erasing apparatus, comprising:

means for printing selected characters;

erasing means for supporting an erase ribbon to move the same from an original position to a printing position in response to printing operation of said printing means;

a retaining member disposed movably between a first position and a second position, and normally positioned at the first position to retain said erasing means in a non-operative status;

manual operating means for moving said retaining member to the second position to preset said erasing means in an operative status wherein the erasing means is operable in response to the printing operation of said printing means;

means for locking said retaining member at the second position, said retaining member held at the second position by said locking means being returned to the first position in response to the printing operation of said printing means;

a manual switch member movable between an ON position and an OFF position for controlling the power supply to said electric motor;

spring means for holding said manual switch member selectively at one of said ON and OFF positions; and means, associated with said locking means and said manual switch member, for returning said retaining member from said second position to said first position in response to movement of said manual switch member from said ON position to said OFF position, said spring means preventing said manual switch member from moving from the OFF position to the ON position and thereby preventing said returning means from permitting said retaining member to be set at said second position even when said manual operating means is operated while said manual switch member is set at said OFF position.

16. A typewriter driven by an electric motor and provided with an erasing apparatus, comprising:

means for printing selected characters;

erasing means for supporting an erase ribbon to move the same from an original position to a printing position in response to printing operation of said printing means, said erasing means comprising a ribbon vibrator which is rotatably disposed about a horizontal axis for supporting at one end portion thereof said erase ribbon, and further comprising a ribbon vibrator actuating mechanism for operating said ribbon vibrator between said original and printing positions in timed relation with said printing operation;

a retaining member disposed movably between a first position and a second position to retain said erasing means in non-operative status, said retaining member being capable of engaging said ribbon vibrator to prevent the same from being rotated about said horizontal axis by said ribbon vibrator actuating mechanism when said retaining member is set at said first position;

manual operating means for moving said retaining member to the second position to preset said erasing means in an operative status wherein the erasing means is operable in response to the printing operation of said printing means;

means for locking said retaining member at the second position, said retaining member held at the second position by said locking means being returned to the first position in response to the printing operation of said printing means;

a manual switch member movable between an ON position and an OFF position for controlling the power supply to said electric motor; and means for returning said retaining member from said second position to said first position in response to movement of said manual member from said ON position to said OFF position.

17. A typewriter driven by an electric motor and provided with an erasing apparatus comprising:

means for printing selected characters;

erasing means for supporting an erase ribbon to move the same from an original position to a printing position in response to printing operation of said printing means;

a retaining member disposed movably between a first position and a second position, and normally positioned at the first position to retain said erasing means in a non-operative status;

manual operating means for moving said retaining member to the second position to preset said erasing means in an operative status wherein the erasing means is operable in response to the printing operation of said printing means;

means for locking said retaining member at the second position, said retaining member held at the second position by said locking means being returned to the first position in response to the printing operation of said printing means;

a manual switch member movable between an ON position and an OFF position for controlling the power supply to said electric motor;

a manual release key disposed on a keyboard of the typewriter and associated with said manual switch member such that the position of said manual switch member is not disturbed by operation of said manual release key; and returning means, directly engaging at one end thereof with at least said manual release key, for causing at the other end to return said retaining member from said second position to said first position either in response to movement of said manual switch member from said ON position to said OFF position or in response to the operation of said manual release key.

18. A typewriter in accordance with claim 17, wherein said manual switch member directly engages said manual release key, and the movement of said manual switch member from the ON position to the OFF position causing said manual release key to be operated.

19. A typewriter in accordance with claim 17 further comprising spring means for holding said manual switch member selectively at one of said ON and OFF positions, and wherein said other end of the returning means is located adjacent said locking means when said manual switch member and said manual release key are set at the ON position and the non-operated position respectively, said spring means and said other end of the returning means cooperating with said locking means to prevent said retaining means to be set at said second position while said manual switch member is set at said OFF position.

20. A typewriter in accordance with claim 17 wherein said manual release key comprises a margin release key.

* * * * *